US005775840A

United States Patent [19]

Knieper et al.

[11] Patent Number: 5,775,840

[45] Date of Patent: Jul. 7, 1998

[54] APPARATUS AND METHOD FOR REMOVAL OF VAPORS FROM SUBSOIL

[76] Inventors: Louis H. Knieper; Gary Tipton, both of 1657 Oak Tree Dr., Houston, Tex. 77080

[21] Appl. No.: 715,526

[22] Filed: Sep. 18, 1996

[51] Int. Cl.[6] ..... E02D 3/00; E02D 31/00

[52] U.S. Cl. ..... 405/128; 405/52

[58] Field of Search ..... 166/105, 369, 166/370; 210/170, 747, 922; 405/52, 128

[56] References Cited

U.S. PATENT DOCUMENTS

| | | | |
|---|---|---|---|
| 4,696,599 | 9/1987 | Rakoczyniski | 405/129 |
| 4,765,902 | 8/1988 | Ely et al. | 210/610 |
| 4,886,119 | 12/1989 | Bernhardt et al. | 166/370 X |
| 5,013,183 | 5/1991 | Eriksson et al. | 405/128 X |
| 5,172,764 | 12/1992 | Hajali et al. | 166/370 X |
| 5,190,405 | 3/1993 | Vinegar et al. | 405/128 |
| 5,387,057 | 2/1995 | DeLoach | 405/128 |
| 5,403,119 | 4/1995 | Hoyle | 405/128 |
| 5,441,365 | 8/1995 | Duffney et al. | 405/128 |
| 5,623,992 | 4/1997 | Shaw | 210/747 X |

OTHER PUBLICATIONS

EPA, Radon Reduction Methods—A Homeowners Guide, OPA-86-005, Aug. 1986, pp. 1-24.

EPA, Radon Rduction Techniques for Detached Houses, EPA/625/5-86/019, Jun. 1986, pp. 1-50.

*Primary Examiner*—George A. Suchfield

*Attorney, Agent, or Firm*—Harrison & Egbert

[57] ABSTRACT

A methods and apparatus for preventing migration of vapors from a subsoil through the stratum which includes a chamber formed within the subsoil, a conduit having an inlet extending into the chamber, and a vacuum pump connected to the conduit for drawing at least a partial vacuum so as to induce vapor migration from the subsoil into the chamber and into the inlet of the conduit and through the conduit. The vacuum pump serves to produce a vacuum of between 5 and 25 inches of mercury. The vacuum pump has the capacity to move greater than 1.5 and less than 5 cubic feet per minute through the conduit. The inlet end of the conduit is received within a cage positioned in the chamber. The cage has at least one inlet aperture for allowing the vapors to pass from the chamber into the inlet of the conduit. A chamber cap is affixed over the chamber so as to prevent ambient air from entering the chamber. The conduit has an inlet located within the chamber and an outlet located at a discharge location.

13 Claims, 2 Drawing Sheets

APPARATUS AND METHOD FOR REMOVAL OF VAPORS FROM SUBSOIL

TECHNICAL FIELD

The present invention relates to methods and apparatus for removing vapors from a subsoil or vapor phases of liquids and solids. More particularly, the present invention relates to vacuum pump apparatus which create a vacuum in the subsoil so as to draw the vapor or vapor phases of liquids and solids from the subsoil for transport to a discharge location.

BACKGROUND ART

Vapors or volatile liquids, when spilled or released, often become trapped in subsoil and eventually migrate downward to the water table or impermeable layer. Materials then move outward horizontally along this interface. Vapors that are lighter than air migrate upward and escape the surface or pass to an area beneath a structure which impedes further migration and acts as a cap causing accumulation. The source of these vapors may be from leaking underground tanks, or liquid spills in the immediate vicinity or may result from vapors migrating from surrounding areas. When vapors accumulate in this manner, the surrounding areas may become unsafe due to the concentration of these toxic, volatile or explosive gases.

A typical site where this problem occurs often has buildings, storage tanks and additional structures including a concrete or asphalt paved area which presents a stratum having a density different from and typically greater than that of the subsoil therebeneath. This stratum can cause vapors to accumulate in the capped area. These sites are usually gasoline service stations and bulk plants which store and dispense hydrocarbons (primarily gasoline and diesel fuels); dry cleaners, solvent blenders or may be areas where effluent radon gases or other noxious fumes migrate and accumulate.

Known prior art techniques for removing underground vapors are either prohibitively expensive, ineffective or cause major disruptions in the operations of surface facilities such as loading, storing, and dispensing hydrocarbon liquids or require halting of business operations while vapors are removed. For example, one solution is to remove the cap trapping the vapors and then remove the subsoil containing the vapors. The subsoil is then replaced with uncontaminated soil and the concrete or asphalt is replaced. As those skilled in the art will appreciate, such a process can be prohibitively expensive; and, in the case of gasoline service stations, would require cessation of operations while subsoil is being replaced. Additionally, this approach does not prevent the new subsoil from again becoming permeated if the source of the vapors is still present.

Another prior art solution involves boring a hole in the contaminated subsoil to a depth below the level of trapped gases. A soil cage is then placed in the hole to serve as an inlet to a blower and air pump connected thereto by a conduit. The air pump produces a large air flow which continually ventilates the hole in order to remove any undesirable gases which may be present therein. This prior art technique, however, only removes these undesirable gases which naturally migrate to the hole. Also, this technique is largely ineffective in that the pump and blower cannot draw gases from within the subsoil and remove them for any significant distance from the hole. Detailed mathematical analyses and computer modeling of this process reveals that the pump and blower will usually produce turbulent flow which creates a positive pressure field at various places in the hole. Rather than removing vapors, this pressure field actually prevents vapors from migrating into the hole for subsequent removal. Also this prior art technique is incapable of removing vapors from the subsoil under a structure, such as a building, which prevents the drilling of bore holes.

Another prior art solution consists of drilling holes in the soil, which are generally drilled to depth of the subsurface water table. A pipe or conduit is placed in the hole and sealed into place. A vacuum pump is attached to the conduit and a moderate to high vacuum is induced in the subsurface soil at the bottom of the conduit. However, all known implementations or practitioners of this approach ignore the fundamental physical laws governing fluid and gas flows in permeable media. More specifically, prior methods and associated apparatus used to create the vacuum does not take into account extant vapor pressures of the air vapor interface, soil porosity, permeability and the physics of fluid and gas flow as described by the Navier-Stokes equation which govern such behavior. The resultant effect of the non-uniform vacuum is to create an erratic and highly variable negative, and sometimes positive, subsurface pressure field. This highly variable pressure field will, in turn, induce turbulent flow streams which subsequently will create a network of narrow channels within the subsoil. Many times the turbulent flow will produce back pressures and prevent vapor flow into the narrow channels. The narrow channels permit vapor extraction only at the interface on the circumference of each channel which is a small fraction of the subsoil volume which hold vapors. In the final stage of this rapidly evolving process ambient air flowing through the subsoil channels constitutes the majority of gaseous volumes being removed; which leaves large quantities of vapors still in the soil.

Another state of the art technique is to utilize removal and injection points that are constructed to the water table by inserting tubing or conduit into drilled holes. These points can be alternately injection or removal points for vapors, heated air, air, carrier gasses, steam, etc. The purpose is to promote a better flow of gasses and vapors to the extraction points. The removal efficiency is still limited to the solubility of the offending vapors in the carrier stream. Channeling and further spread of contamination are potential concerns. Various barriers may be employed at the surface or horizontally to control escape of materials due to pressure gradients created by injection.

One example of such a technique is described in U.S. Pat. No. 5,076,727, issued on Dec. 31, 1991 to Paul C. Johnson et al. This patent describes the in situ decontamination of spills and landfills by focussed microwave/radio frequency heating and a closed-loop vapor flushing and vacuum recovery system. Moist, warm, clean air from a vapor treatment system is injected into the wells which are screened only at the contaminated depth so as to force vapor flow only through the contaminated region. Intermediate the injection well is an extraction well which is also screened only at the contaminated depth. A vacuum is drawn on the extraction well drawing the flushing vapors from the injection wells and toward the extraction well through the contaminated soil. As a result, some of the contaminants are entrained. The contaminants include non-volatile hydrocarbons, such as diesel fuel, aviation and jet fuel, crude oil or pesticides. The contaminated, flushing vapor is then treated and recycled. A microwave/radio frequency heating system heats the earth's surface and the contaminated soil so as to enhance volatilization of the contaminants and their removal away of the vapor flushing system. By screening the wells only through the contaminated zone and controlling the flow of clean, moist warm air through the contaminated region, the contaminated zone is maintained in a moist state. Such a system can be generally ineffective in treating the vapors in the soil for the reasons recited in the paragraphs hereinbefore.

It is an object of the present invention to provide a method and apparatus for effectively removing undesirable vapors from a subsoil.

It is another object of the present invention to provide a method and apparatus for preventing the migration of vapors from a soil through a stratum.

It is still another object of the present invention to provide a method and apparatus for the removal of vapors from a subsoil which is not limited to the vapor saturation point of air.

It is another object of the present invention to provide a method and apparatus which increases the vaporization of contaminants by reducing the ambient pressure.

It is still another object of the present invention to provide a method and apparatus for the removal of vapors from a subsoil which allows for the quicker and easier installation of the vapor removal equipment at a lower cost.

It is still a further object of the present invention to provide a method and apparatus for the removal of vapors from a subsoil which avoids the "channeling" of vapor flow.

It is still another object of the present invention to provide a method and apparatus for the removal of vapors from a subsoil which is easy to use, easy to implement, and relatively inexpensive.

These and other objects and advantages of the present invention will become apparent from a reading of the attached specification and appended claims.

SUMMARY OF THE INVENTION

The present invention is an apparatus for preventing the migration of vapors from a subsoil through a stratum which comprises a chamber formed within the subsoil, a conduit having an inlet extending into the chamber, and a vacuum pump connected to the conduit so as to draw at least a partial vacuum so as to induce vapor migration from the subsoil into the chamber and into and through the conduit. The conduit has an outlet at a discharge location.

The vacuum pump is a diaphragm-type pump which is connected between the inlet and the outlet of the conduit. This vacuum pump has the capacity for moving greater than 1.5 cubic feet per minute and less than 5 cubic feet per minute of vapor through the conduit. The vacuum pump produces a vacuum of between 5 and 25 inches of mercury.

The inlet of the conduit is received within a cage positioned in the chamber. The cage has at least one inlet aperture for allowing the vapor to pass from the chamber to the inlet of the conduit. The cage surrounds the inlet of the conduit. The cage has a first aperture extending through a bottom of the cage and a plurality of second apertures extending through a side of the cage. Each of the plurality of second apertures are angled such that the opening of the aperture on the exterior of the cage is closer to the bottom of the cage than the opening on the interior of the cage. The conduit has a sealed end within the chamber. The inlet of the conduit includes a plurality of holes which extend radially through the wall of the conduit. A float valve is positioned in the inlet of the conduit so as to prevent the flow of liquids through the conduit.

In the present invention, a chamber cap is affixed over the chamber so as to prevent ambient air from entering the chamber. The conduit extends through this chamber cap. Ideally, a stratum extends over the subsoil area to which the present invention is applied.

The present invention is also a method of removing a vapor from a subsoil containing the vapor which comprises the steps of: (1) forming a chamber within the subsoil; (2) drawing a vacuum of between 5 and 15 inches of mercury within the chamber so as to induce migration of the vapor from the subsoil into the chamber; and (3) transporting the vapor from the chamber to a discharge location. In particular, the step of forming the chamber employs the steps of drilling a hole into the subsoil, placing an inlet of a conduit within the chamber such that the conduit extends outwardly of the chamber, and sealing a top of the chamber so as to prevent ambient air from entering the chamber. The inlet of the conduit is positioned within a cage. The cage is positioned within the chamber. The cage has at least one aperture therein so as to allow the vapor to pass therethrough from the chamber to the inlet.

In the present method, the step of drawing a vacuum includes the step of connecting a vacuum pump to the conduit so as to cause the vapor to flow into the inlet of the conduit and through the conduit. The vacuum pump serves to move between 1.5 and 5 cubic feet per minute through the conduit. The vacuum pump will shut down when the vacuum within the chamber is below a desired level.

Also, within the method of the present invention, a plurality of chambers can be formed in the subsoil in a desired pattern so as to create a complete containment field around the undesirable vapors. When a plurality of chambers are formed in the desired pattern, the method includes the step of drawing a vacuum of between 5 and 25 inches of mercury within each of the chambers so as to induce migration of the vapor from the subsoil into the plurality of chambers. The undesirable vapor is then transported from the plurality of chambers to a discharge location.

DETAILED DESCRIPTION OF THE INVENTION

Figure 1:
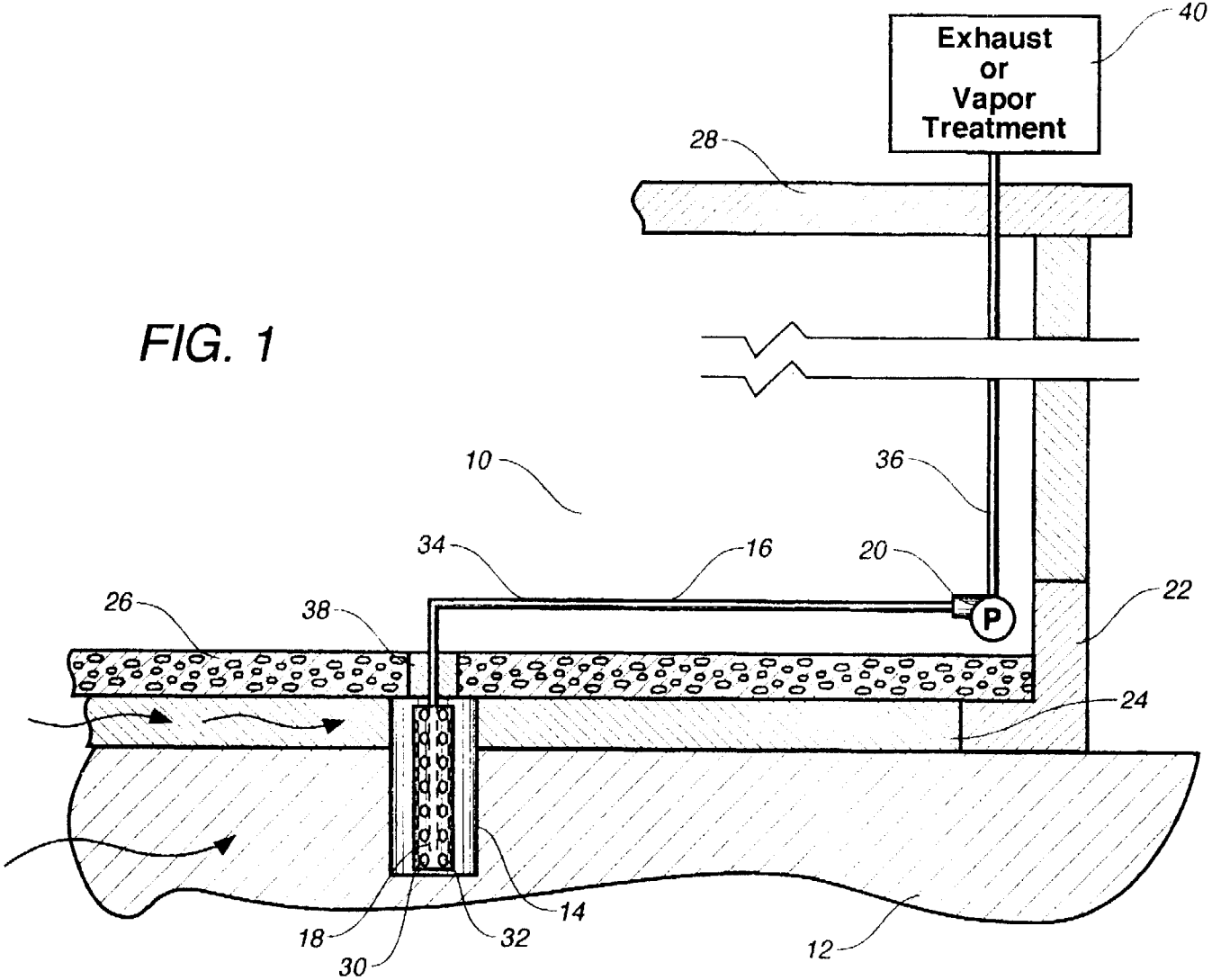
FIG. 1 is a cross-sectional view showing the construction of the apparatus and application of the method of the present invention.

There is shown in FIG. 1 the apparatus 10 of the present invention for the removal of vapors from a subsoil 12. The apparatus 10 of the present invention includes a chamber 14 which is formed in the subsoil 12, a conduit 16 having an inlet 18 extending into the chamber 14, and a vacuum pump 20 connected to the conduit 16 so as to draw at least a partial vacuum for inducing vapor migration from the subsoil 12 into the chamber 14. In particular, in FIG. 1, it can be seen that the apparatus 10 is applied within a building 22 having a foundation 24, a stratum 26 and a roof 28. Although a building is shown in FIG. 1, the apparatus 10 is applicable within a variety of other areas, such as open parking lots, fields and chemical plants.

Initially, in FIG. 1, the subsoil 12 is located beneath the foundation 24 and the stratum 26. The apparatus 10 of the present invention can be used whenever the subsoil 12 contains an undesirable vapor. The subsoil 12 can be in a typical location where the problem of undesirable vapors occurs. For example, the subsoil 12 can be located beneath a building (such as building structure 22), below a storage tank or below other structures. Typically, the foundation 24 or the stratum 26 is a soil, concrete, plastic or asphalt covered area which presents a stratum having a density different from and typically greater than that of the subsoil 12. As a result, the undesirable vapors will tend to accumulate in the subsoil 12. The building structure 22 can represent places such as gasoline service stations, bulk plants which store and dispense hydrocarbons (primarily gasoline and diesel fuels), dry cleaners, airports, military bases, industrial sites and solvent blenders. Additionally, the subsoil 12 can also be in areas where effluent radon gases or other noxious fumes migrate and accumulate.

The chamber 14 is a hole which is drilled through the foundation 24 and into the subsoil 12. The interior of the chamber 14 should have a sufficient area so as to accommodate the installation of the end 18 of the conduit 16. In practice, the chamber 14 is initially created by drilling a hole of four to six inches in diameter through the foundation 24 and into the subsoil 12 for a depth of approximately two feet.

As shown in FIG. 1, the stratum 26 is placed over the top surface of the foundation 24. Under certain circumstances, the foundation 24 can be somewhat porous due to penetrations, expansion joints or cracks therein. So as to prevent the migration of ambient air through the foundation 24 into the chamber 14, the stratum 26 is placed over the top of the foundation 24. The stratum 26 serves to prevent any migration of ambient air into the chamber 14 and also to prevent vertical upward migration of the undesirable vapors from the subsoil, through the foundation 24, and into the atmosphere.

The conduit 16 has an inlet end 18 extending into the interior of the chamber 14. The inlet end 18 of the conduit 16 is surrounded by a cage 30. The cage 30 (shown in greater detail in FIG. 2) is of a tubular configuration and includes a plurality of inlet apertures 32 extending radially through the walls of the cage 30. The use of the cage 30 is preferred so as to maintain the configuration of the chamber 14 in the event that the subsoil walls, which define the chamber 14, collapse. The cage 30 also serves to prevent any clogging of the inlet 18 of the conduit 16. The inlet apertures 32 allow fluids, removed from the soil in the vicinity of the chamber 14, to pass therethrough for entrance into the inlet end 18 and through to conduit 16.

The conduit 16 is preferably ¼ inch copper refrigeration tubing. Alternatively, the conduit 16 can be formed of any suitable material, such as plastic or stainless steel tubing or piping with air-tight fittings. The conduit 16 includes a suction line 34 and an exhaust line 36. Pump 20 is connected to the conduit 16 between the suction line 34 and the exhaust line 36. The suction line 34 of the conduit 16 extends to the inlet 18 located within the cage 30 in the chamber 14. The suction line 34 extends outwardly of the chamber 14 through the stratum 26. So as to prevent air migration through the stratum 26, a chamber cap 38 is placed into the stratum 26 so as to seal the top of the chamber 14. The conduit 16 will extend through this chamber cap 38. The chamber cap 38 may be formed of concrete, grout, bentonite, asphalt, or other suitable patching compounds, so as to effectively seal the chamber 14.

The exhaust line 36 of conduit 16 extends from the outlet of the pump 20 so as to allow the removed vapors to exit the building 22. The outlet of the exhaust line 36 will pass as exhaust outwardly of the roof 28 of the building 22 or will pass to a suitable vapor treatment apparatus 40. The exhaust should pass at least twelve feet above the ground level in order to properly disperse the vapors from the interior of the building 22. Alternatively, the vapors can be suitably treated by recovery equipment, destruction equipment, or scrubber systems. Also, filters, such as carbon filters, chillers, catalytic burners, and other apparatus can be used if needed to prevent transfer of the undesirable gases to the surrounding environment.

The pump 20 is, preferably, a diaphragm-type pump having the capability of moving a volume of 1.5 to 5 cubic feet per minute while drawing a vacuum between 5 and 25 inches of mercury. The diaphragm construction of the pump 20 allows it to effectively operate in high moisture environments such as those often associated with subsoils. It can also allow the removal of any liquids which might accumulate in inlet 18 and conduit 30, along with the gases.

Even though the stratum 26, which is typically concrete or asphalt, may be relatively impervious to the vapors trapped in the subsoil 12, these vapors can gradually migrate through the foundation 24 and the stratum 26 because of its somewhat porous nature and because of penetrations, expansion joints, or cracks therein. The apparatus 10 of the present invention reverses this migration because of the pressure gradient caused by the vacuum within the chamber 14. A pressure gradient across the stratum is induced which reduces the upward migration of undesirable vapors therethrough. This is because of the difference between the ambient air pressure above the stratum 26 and the partial vacuum within the chamber 14.

The partial vacuum within the chamber 14 induces a pressure gradient within the subsoil 12 in the vicinity of the chamber 14. This causes active migration of the vapors from the subsoil 12 into the chamber 14 for removal therefrom. This is in contrast to prior art devices and techniques which merely remove any gases which might accumulate in the borehole but do not actively induce migration of the gases from the surrounding subsoil. The effective gas removal radius surrounding the chamber 14 is dependent among the amount of partial vacuum within the chamber 14 and upon the nature of the subsoil 12. For example, this effective radius is between 15 and 20 feet in silt and clays, 30 to 50 feet in coarse sand, and 50 to 60 feet in crushed rock or gravel. As will be described in conjunction with FIGS. 3 and 4, with a sufficient number of installations of the apparatus 10, vapors can be removed from an affected area even if this area is larger than the effective radius of a single apparatus 10. The apparatus 10 of the present invention is effective for the removal of a variety of undesirable gases such as gasoline or diesel fumes or a naturally-occurring radon gas or hydrogen sulfate gas.

Figure 2:
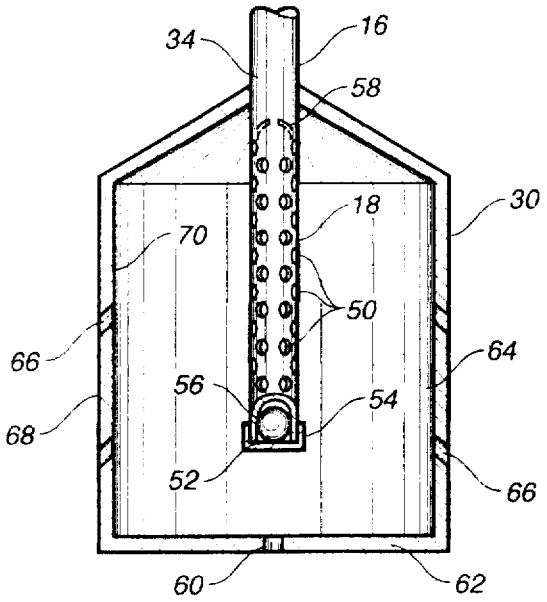
FIG. 2 is a detailed cross-sectional view of the inlet and cage as used in the apparatus of the present invention.

FIG. 2 shows a detailed illustration of the cage 30 which extends over the inlet end 18 of the conduit 16. Initially, the cage 30 is affixed to the outer surface of the conduit 16 above the opening 50 of the inlet 18. As can be seen in FIG. 2, the end 52 of the conduit 16 is sealed with a cap 54. The inlet of gases into the conduit 16 is provided by the holes 50 which extend radially through the wall of the suction line 34 of conduit 16. A float valve 56 is provided on the interior of the inlet 18 so as to prevent liquids from entering the interior of the conduit 16. The float valve 56 is a ball which will rise within the interior of the inlet 18 upon the introduction of liquids into the interior of the inlet 18. Eventually, the ball 56 will rise until it abuts seat 58 located adjacent to the top of the cage 30. When the ball 56 has floated to its seat 58, it will seal the liquid from entering conduit 16 and passing to the pump 20. When the float valve 56 is effectively sealed within its seat 58, no further vacuum can be drawn into the chamber 14.

The cage 30 has a first aperture 60 which is located at the bottom 62 of the cage 30. The aperture 60 allows any liquids on the interior of the cage 30 to pass outwardly from the interior 64 of the cage 30. Additionally, side apertures 66 are formed through the walls of the cage 30. Importantly, the apertures 66 have an angled configuration which extend downwardly toward the outside of the wall of the cage 30. In other words, the opening on the exterior surface 68 of the cage 30 is lower than the opening on the interior 70 of the cage 30. This angling of the aperture 66 will resist the entry of soil therein. Additionally, because of the angled configuration, any soil which would enter the apertures 66 would have a tendency to drop outwardly therefrom upon the removal of the vacuum from the chamber 14. As such, the configuration of the aperture 66 allow the cage 30 to be effectively flushed. The aperture 66 allow vapors from the chamber 14 to pass therethrough so as to enter the inlet 18 of the conduit 16.

Figure 3:
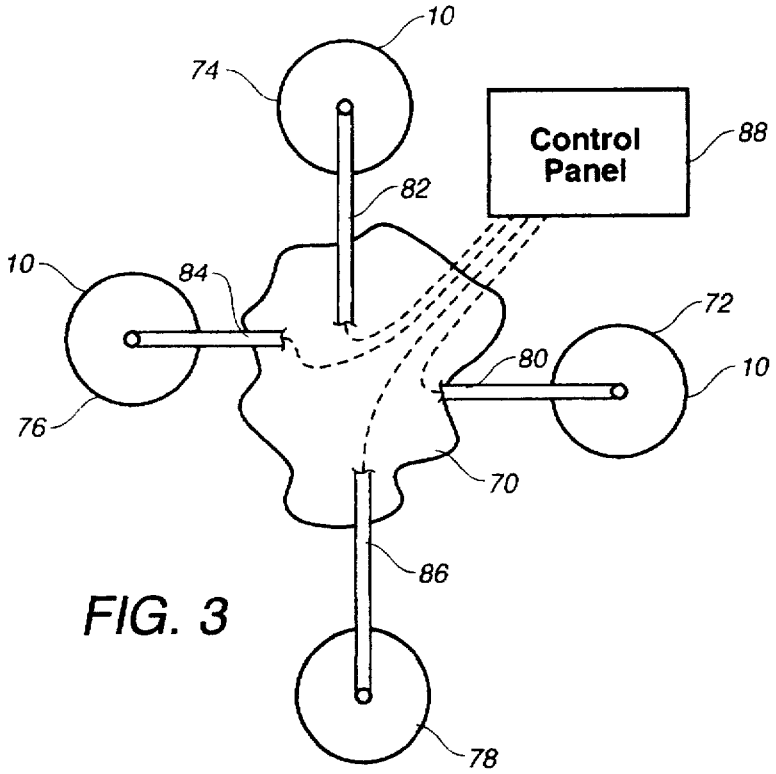
FIG. 3 is a plan view showing the installation of a plurality of vapor removal chambers in a desired pattern.

FIG. 3 shows how a plurality of the chambers 14 of the present invention can be employed so as to create a vapor "fence" or barrier around a vapor site 70. In FIG. 3, it can be seen that the vapor site 70 has a somewhat irregular configuration. So as to effectively prevent the migration of vapors outwardly of the site 70, the chambers 72, 74, 76 and 78 are positioned around the site 70. It can be seen that conduit 80 extends from chamber 72, conduit 82 extends from chamber 74, conduit 84 extends from chamber 76 and conduit 86 extends from chamber 78. Depending upon the desired application, separate pumps can be connected to each of the conduits 80, 82, 84 and 86 or a single pump, with proper controls, can be connected to all of the conduits. The conduits 80, 82, 84 and 86 will extend to a suitable control panel or control facility 88.

In normal application, each of the chambers 72, 74, 76 and 78 will function in the manner described in conjunction with FIG. 1. Since the chambers 72, 74, 76 and 78 surround the vapor site 70, they will tend to resist the migration of vapors from the site 70 in all directions. When the pumps are suitably activated, each of the chambers 72, 74, 76 and 78 will tend to draw the vapors from the site 70 so as to reduce the area of the site 70. The negative pressure field is propagated uniformly within each of the chambers and has a sufficient strength so as to vaporize liquids, such as gasoline and diesel, or to induce the migration of heavy gases such as radon, in addition to removing vapors. This constant pressure is propagated in such a manner that it will not induce erratic or turbulent flows which would create soil channeling. As such, by installing a plurality of the chambers around a vapor site, effective "fencing" of the vapor can be achieved. The installation of many of the apparatus 10 of the present invention can be used so as to prevent the migration of the vapors in a direction past the apparatus 10. As such, the present invention can serve as a barrier to prevent the entry of vapors or as a barrier to prevent the migration of vapors to a different location.

Figure 4:
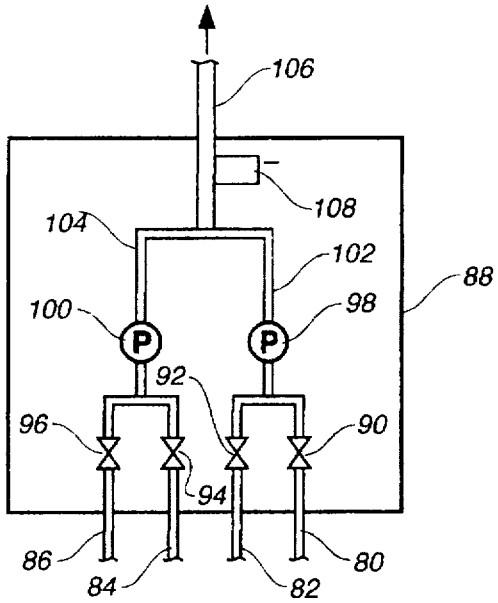
FIG. 4 shows a schematic representation of a control panel used with the multi-chamber vapor removal apparatus of FIG. 3.

FIG. 4 shows the control panel 88 which receives each of the outlets of the conduits 80, 82, 84 and 86. As can be seen in FIG. 4, a valve 90 is connected to conduit 80, a valve 92 is connected to conduit 82, a valve 94 is connected to conduit 84, and a valve 96 is connected to conduit 86. The use of the valves 90, 92, 94 and 96 allows for separate measurement and control of the various apparatus 10 employed in the multiple unit field of FIG. 3. A first pressure gauge 98 is connected to the conduits 80 and 82. A second pressure gauge 100 is connected to the conduits 84 and 86. When it is desired to test the amount of vacuum which is being applied within each of the chambers 72 and 74, the valves 90 and 92 can be alternately opened or closed so as to carry out a measurement with pressure gauge 98. A similar action can be carried out with respect to the vacuum in the chambers 76 and 78 by using the pressure gauge 100. Each of the conduits 80, 82, 84 and 86 eventually pass into lines 102 and 104 prior to exiting the control panel 88 through exhaust line 106. A port 108 is connected along the exhaust line 106 so as to effectively test the quality of the vapor which is passing outwardly through the exhaust line 106. If it is important to determine the quality of the vapor which is being received by the chamber 72, then the valves 92, 94 and 96 can be closed so as to allow only vapor from the chamber 72 through conduit 80 to pass outwardly through the exhaust line 106. As such, a single testing port can be used for all of the lines employed in a multi-unit system.

The present invention has a great number of advantages over prior art systems. Since the present invention relies solely on vacuum as the manner of receiving the vapors from the subsoil, air is not used as a carrier. As such, the apparatus 10 of the present invention is not limited to the vapor saturation point of air. Furthermore, the apparatus 10 of the present invention increases the vaporization of the contaminants by reducing the ambient pressure, in the manner of boiling water at high altitudes. Since the present invention can simply be installed by drilling a hole, installing the inlet, and capping the hole, the present invention employs a much lower cost of equipment, and an easier and quicker installation technique than prior systems. The use of a vacuum, without air transport, will prevent the "channeling" which can often occur through the use of air injection or high flow systems. The system of the present invention can be installed quickly if an undesirable vapor area is discovered. Additionally, the high vacuum, low flow operation of the present invention avoids the infiltration of surface air and allows the containment to be removed at high concentrations.

The present invention relies on a low flow rate with high vacuum. As such, it allows the vacuum condition to propagate outwardly from the chamber/collector 14. The pump will operate until it reaches a certain level of vacuum (such as 30 inches of mercury), and then it will shut off. When the level of vacuum goes below this limit, then the pump is reactivated. As such, the pump will not operate in an overload condition by pulling excessive vacuum. The system can remain in the contaminated area even after the area is cleaned up. It can simply be used for the monitoring of the area after cleanup. Since the system is already in place, it can be used for future emergency response.

The foregoing disclosure and description of the invention is illustrative and explanatory thereof. Various changes in the details of the illustrated construction or in the steps of the described method can be made within the scope of the appended claims without departing from the true spirit of the invention. The present invention should only be limited by the following claims and their legal equivalents.

I claim:

1. An apparatus for preventing migration of a vapor from a subsoil comprising:

a chamber formed within the subsoil;

a conduit having an inlet extending into said chamber, said conduit having an outlet at a discharge location, said inlet of said conduit being received within a cage positioned in said chamber, said cage having at least one inlet aperture for allowing the vapor to pass from said chamber into said inlet of said conduit, said cage surrounding said inlet of said conduit, said cage having a first aperture extending through a bottom of said cage, said cage having a plurality of second apertures extending through a side of said cage; and a vacuum pump means connected to said conduit for drawing at least a partial vacuum so as to induce vapor migration from the subsoil into said chamber and into said inlet of said conduit and through said conduit.

2. The apparatus of claim 1, said vacuum pump means producing a vacuum of between 5 and 25 inches of mercury.

3. The apparatus of claim 1, said vacuum pump means having a capacity for moving greater than 1.5 cubic feet per minute through said conduit.

4. The apparatus of claim 3, said vacuum pump means having a capacity for moving not more than 5 cubic feet per minute through said conduit.

5. The apparatus of claim 1, said vacuum pump means being a diaphragm-type pump connected between said inlet and said outlet of said conduit.

6. The apparatus of claim 1, each of said plurality of second apertures being angled such that an opening of the second conduit at an outside of the cage is closer to said bottom than an opening of the second aperture at an interior of said cage.

7. An apparatus for preventing migration of a vapor from a subsoil comprising:

a chamber formed within the subsoil;

a conduit having an inlet extending into said chamber, said conduit having an outlet at a discharge location, said conduit having a sealed end within said chamber, said inlet comprising a plurality of holes extending radially through a wall of said conduit, said conduit further comprising a float valve means positioned within the inlet of said conduit, said float valve means for preventing a flow of liquids through said conduit; and a vacuum pump means connected to said conduit for drawing at least a partial vacuum so as to induce vapor migration from the subsoil into said chamber and into said inlet of said conduit and through said conduit.

8. The apparatus of claim 1, further comprising:

a chamber cap means affixed over said chamber for preventing ambient air from entering said chamber, said conduit extending through said chamber cap means.

9. The apparatus of claim 1, said discharge end of said conduit being positioned at least twelve feet above said chamber.

10. A method of removing a vapor from a subsoil that contains the vapor comprising the steps of:

forming a chamber within the subsoil, said step of forming the chamber comprising the steps of:

drilling a hole into the subsoil;

placing an inlet of a conduit within said chamber such that conduit extends outwardly of said chamber;

sealing a top of said chamber so as to prevent ambient air from entering said chamber; and positioning the inlet of said conduit within a cage, said cage positioned within said chamber, said cage having an aperture therein so as to allow the vapor to pass therethrough from said chamber to said inlet, said cage surrounding said inlet of said conduit, said cage having a first aperture extending through a bottom of said cage, said cage having a plurality of second apertures extending through a side of said cage;

drawing a vacuum of between 5 and 25 inches of mercury within said chamber so as to induce migration of the vapor from the subsoil into the chamber; and transporting the vapor from said chamber to a discharge station.

11. The method of claim 10, said step of drawing a vacuum comprising the step of:

connecting a vacuum pump to said conduit so as to cause the vapor to flow into said inlet and through said conduit, said vacuum pump for moving up to 5 cubic feet per minute through said conduit.

12. The method of claim 11, the method further comprising the step of:

deactivating the vacuum pump when the vacuum in the chamber is greater than thirty inches of mercury.

13. The method of claim 10, further comprising the step of:

forming a stratum over the subsoil prior to said step of drawing a vacuum so as to prevent migration of the vapor vertically upwardly through the subsoil.

* * * * *